US008844406B2

(12) United States Patent
Ferraro

(10) Patent No.: US 8,844,406 B2
(45) **Date of Patent: *Sep. 30, 2014**

(54) BOTTLE SEAL BREAKER

(71) Applicant: Joseph Ferraro, Seaford, NY (US)

(72) Inventor: Joseph Ferraro, Seaford, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/143,704

(22) Filed: Dec. 30, 2013

(65) Prior Publication Data

US 2014/0110407 A1 Apr. 24, 2014

Related U.S. Application Data

(63) Continuation of application No. 12/927,877, filed on Nov. 29, 2010, now Pat. No. 8,616,090.

(60) Provisional application No. 61/455,488, filed on Oct. 21, 2010, provisional application No. 61/283,144, filed on Nov. 30, 2009.

(51) Int. Cl.

| | |
|---|---|
| ***B67B 7/14*** | (2006.01) |
| ***B67B 7/18*** | (2006.01) |
| ***B65D 41/32*** | (2006.01) |
| ***B65D 51/22*** | (2006.01) |
| ***B67B 7/00*** | (2006.01) |

(52) U.S. Cl.

CPC ..... *B65D 41/325* (2013.01); *B65D 2251/0093* (2013.01); *B65D 51/228* (2013.01); *B65D 2251/0015* (2013.01); *B65D 51/221* (2013.01); *B67B 7/24* (2013.01)

USPC ..... 81/3.48; 81/3.4

(58) Field of Classification Search

USPC ..... 81/3.4, 3.09; 7/151

See application file for complete search history.

(56) References Cited

U.S. PATENT DOCUMENTS

| | | | | |
|---|---|---|---|---|
| 1,100,433 | A | 6/1914 | Johnson | |
| D55,395 | S | 6/1920 | O'Brien | |
| 1,703,759 | A | 2/1929 | Ament | |
| 2,702,652 | A | 2/1955 | Joyce | |
| 2,771,218 | A | 11/1956 | Henderson | |
| 2,828,890 | A | 4/1958 | Brownfield | |
| 2,857,068 | A | 10/1958 | Kraepelin | |
| D196,112 | S | 8/1963 | Esser | |
| 3,581,605 | A | 6/1971 | Taylor | |
| D250,168 | S | 11/1978 | Brandt | |
| 4,340,147 | A | 7/1982 | McIntosh | |
| 4,634,013 | A * | 1/1987 | Bar-Kokhba | 215/228 |
| 4,709,822 | A | 12/1987 | Vataru | |
| D310,969 | S | 10/1990 | Butler | |
| 5,090,582 | A | 2/1992 | Art | |
| RE33,886 | E | 4/1992 | Ullman | |
| 5,148,937 | A | 9/1992 | Huard | |
| 5,280,764 | A | 1/1994 | Levinrad | |
| 5,388,297 | A | 2/1995 | Ross | |

(Continued)

FOREIGN PATENT DOCUMENTS

| | | | |
|---|---|---|---|
| WO | WO9716355 | A1 | 5/1997 |
| WO | WO0075034 | A1 | 12/2000 |

*Primary Examiner* — Monica Carter
*Assistant Examiner* — Danny Hong
(74) *Attorney, Agent, or Firm* — Alfred M. Walker

(57) ABSTRACT

A seal breaker to break the seal of a container includes the container cap having either one or more slots with an adjacent rigid portion capable of penetrating the seal or one or more pointed projections capable of penetrating the seal or one or more pointed projections.

8 Claims, 3 Drawing Sheets

(56) References Cited

U.S. PATENT DOCUMENTS

| | | | | |
|---|---|---|---|---|
| 5,566,859 | A | 10/1996 | Willis | |
| 5,709,311 | A | 1/1998 | Butler | |
| 5,791,505 | A | 8/1998 | Gilliland | |
| D405,371 | S | 2/1999 | Herr | |
| 5,865,330 | A | 2/1999 | Buono | |
| 6,024,234 | A | 2/2000 | Rink | |
| 6,039,198 | A | 3/2000 | Wolfe | |
| 6,089,391 | A | 7/2000 | Abelbeck | |
| 6,105,468 | A | 8/2000 | Fohrman | |
| 6,598,757 | B2 | 7/2003 | Stillinger | |
| D519,843 | S | 5/2006 | Forte | |
| 7,175,043 | B2 | 2/2007 | O'Neal | |
| 7,410,071 | B1 | 8/2008 | Seib | |
| 8,616,090 | B2 * | 12/2013 | Ferraro | 81/3.48 |
| 2004/0111803 | A1 | 6/2004 | Mazur | |
| 2007/0181522 | A1 | 8/2007 | Davidson | |
| 2007/0205198 | A1 | 9/2007 | Huber | |
| 2008/0098604 | A1 | 5/2008 | Levi | |

* cited by examiner

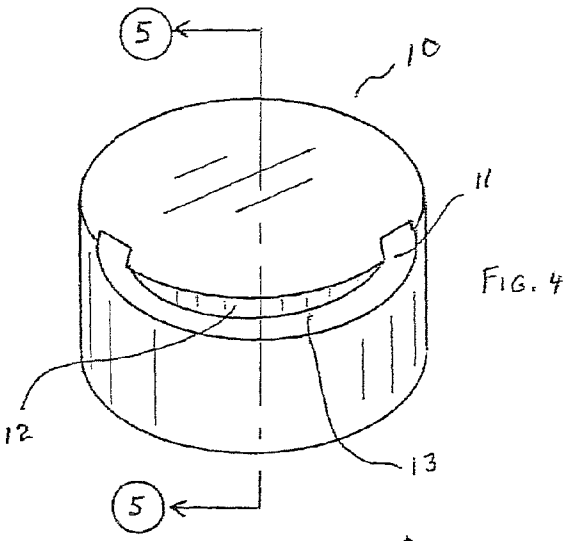
FIG. 4
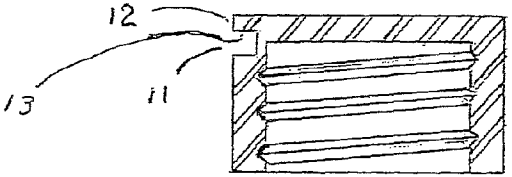
FIG. 5
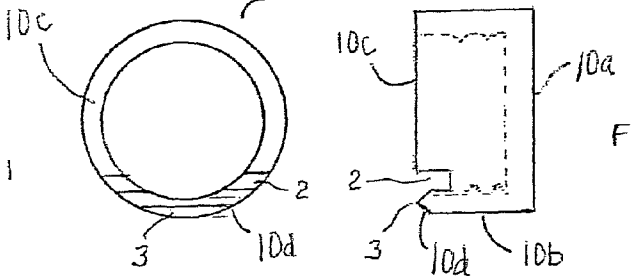
FIG. 2
FIG. 1
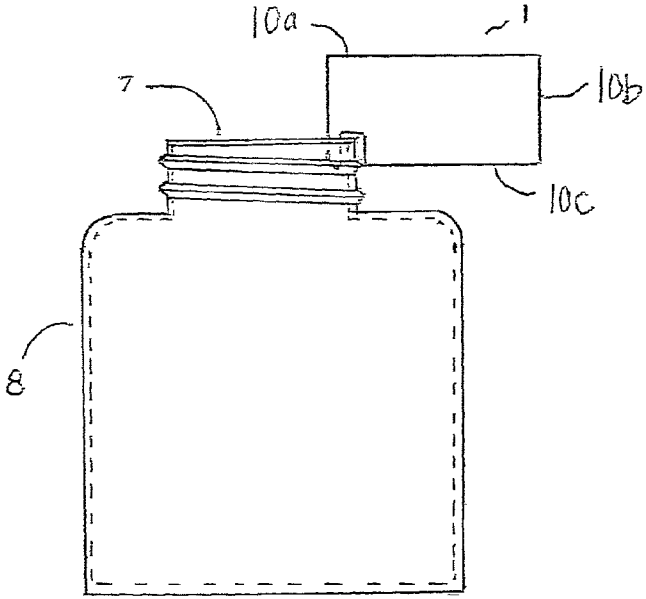
FIG. 3

BOTTLE SEAL BREAKER

RELATED APPLICATIONS

This application is based upon provisional patent application Ser. No. 61/283,144, filed Nov. 30, 2009 and provisional patent application Ser. No. 61/455,488, filed Oct. 21, 2010, which applications are incorporated by reference herein. Applicant claims the benefit of 35 U.S.C. §119(e) and claims priority therefrom. This application is also claims priority under 35 U.S.C. §120 from application Ser. No. 12/927,877 filed Nov. 29, 2010. The aforementioned applications are incorporated by reference herein.

FIELD OF THE INVENTION

The present invention relates to medicine and other commodity container caps adapted to puncture factory packed seals.

BACKGROUND OF THE INVENTION

Many containers that are factory packaged are sealed by a tamper evident seal adhesively attached over the opening. This is typical of medicine bottles, jars of peanut butter or other food items, and even some items sold in plastic containers such as yogurt. Other industries also use similar packaging using seals; these include automotive, marine, manufacturing, chemicals, pharmaceutical & medical products, biotech, and others. These packaging containers may contain liquid, powder, or solid products. These seals may be aluminum foil, cardboard, or plastic membranes. When a screw-on cap is used, they are to be found sealing the opening underneath the cap. Although some seals have integral tabs or removal attachments, they are typically difficult to grasp and require excessive force to remove. Other seals have no removal means whatsoever leaving the consumer to improvise some apparatus and method such as using a pointed object including scissors, knife, pencil, pen, tooth brush handle, etc. Besides the inconvenience of not having such objects handy, with an aging population some of these devices are an injury hazard. They may also contaminate the very product being protected from contamination by the seal.

Among related patents include U.S. Pat. No. 5,709,311 of Butler, which discloses a cap which has an array of protruding pointed blades inside a well recess in the cap, which, when the cap is inverted, puncture the seal of the container. U.S. Pat. No. 5,791,505 of Gilliland describes a cap which has a pivotable blade that lifts up from the cap to act as a blade to puncture the seal. U.S. Pat. No. 1,100,433 of Johnson describes a toothpaste tube cap with a well in the top having a sharp spur or point, which, when the cap is inverted, punctures the seal at the top of the toothpaste tube. U.S. Pat. No. 2,771,218 of Henderson describes a similar cap which does not need to be inverted. As the cap is screwed downward on the neck of the tube, a point 15 punctures the seal at the neck of the tube.

U.S. Pat. No. 4,340,147 of McIntosh is similar to Johnson except it has a pointed tip, which pierces a seal at the top of a non-squeeze tube hollow container. U.S. Pat. No. 4,634,013 of Bar-Kokhba describes a small blade 32 which is inside the cap for cutting a seal and a slit 38. However, the slit is provided for liquid flow, not for piercing the seal. U.S. Pat. No. 4,709,822 of Vataru describes a child-resistant tamper-proof cap for a bottle, which has a small blade attached to the cap to puncture a seal. A similar blade in a cap is in the U.S. Pat. No. 5,090,582 of Art.

U.S. Pat. No. 6,024,234 of Rink and U.S. Pat. No. 6,039,198 of Wolfe each describe caps which also have a recess with a blade to puncture the seal of a tamper-proof container. U.S. Pat. No. 7,410,071 of Seib describes a cap which has a triangular blade for opening a seal.

U.S. Pat. No. 5,865,330 of Buono, U.S. Pat. D405,371 of Herr and U.S. Pat. D519,843S of Forte each describe medicine container caps with a pair of vertically extending slits, wherein between each respective pair of slits is a non-rigid, malleable flap which is inwardly compressible for release of the cap from the container.

However, the prior art patents do not disclose a medicine or other commodity holding container cap having a pair of slits wide enough to engage over the edge of the medicine or other commodity container, with a rigid section between the slits capable of urging force against the seal of the container with sufficient force to rupture the seal.

OBJECTS OF THE INVENTION

It is therefore an object of the present invention to provide a medicine or other commodity holding container cap having a pair of slits wide enough to engage over the edge of the medicine or other commodity container, with a rigid section between the slits capable of urging force against the seal of the container with sufficient force to rupture the seal.

It is also an object of the present invention to provide a cap opener in a cap which does not require inversion of the cap to puncture a seal.

It is also an object of the present invention to provide an ergonomically easy opener for tight seals extending over a medicine or other commodity container.

Other objects which become apparent from the following description of the present invention.

SUMMARY OF THE INVENTION

The object of this invention is to provide several embodiments of seal breakers or removers. Except for the last embodiment, these devices are packaged as part of the container itself so that they are always available when needed. They are ergonomically designed and minimize the occasion of injury or contamination of the product.

In the first embodiment, the bottom edge of the cap has a straight notch going across forming a short outer segment. The notch is wide enough and deep enough to permit the short outer segment with or without a knife edge to easily penetrate the seal when pushed into it at a point where the seal meets the bottle. Then by twisting the bottle or the cap, the seal is easily cut away and removed.

In the second embodiment, a curved slot on the side of the cap near the top surface is used to cut the seal by holding the cap vertically. The slot is wide enough to fit over the thread on the bottle and deep enough to break through the seal; the slot forms a narrow curved segment at the top edge. With or without a knife edge, this segment pushes through the seal at any point along the edge where the seal meets the bottle; then either the bottle or the vertically held cap is twisted to remove the rest of the seal. Note that in the first or second embodiment material is removed from the cap to form the features of this invention. Since less material is then used to form the cap, there are consequent savings in material, energy and pollution.

In the third embodiment, two points are formed along the periphery of the cap 180 degrees apart. While not sharpened, either point is sufficient to push through and easily penetrate the seal. By ergonomically blending the points into the round perimeter, this also enhances the leverage at lower grasping force to twist open the bottle cap thereby attracting an aging consumer set.

In the fourth embodiment, a point is formed at the lower edge of the side of the cap facing downward. This point is then used to penetrate the seal for removal.

In the fifth embodiment of this invention, a rigid flat tab with a pointed molded edge on one surface near one end is attached to the seal with the pointed line against the seal. Pressure at the end with the pointed line will tear through the seal whereupon the seal can be torn away easily.

In the sixth embodiment, a rigid tab with sharp edges is laminated into the surface of the seal. Pressure on the tab will cut through the seal for removal.

The seventh embodiment deviates from the other six in that it is not part of the packaging. It is a multi-purpose tool which is also capable of removing a packaging seal. It is a flat molded rigid plastic item with some edges formed as a knife edge. Alternatively, tins tool can be made of metal such as stainless steel or aluminum for example. At the back end is a long flat handle with a hole for a key ring, chain, or lanyard for easy access. At the front end is a short pointed extension with cutting edges along the sides and point. Also at the front is a claw branching out from one side of the pointed extension with a slot separating the extension from the claw root. The claw has a knife edge on its inner curvature.

To remove a seal, the point is used to pierce it near the edge where edge of the seal meets the bottle opening. The tool is twisted slightly such that the slot rides the edge of the bottle opening. Then the tool is simply rotated around the opening cutting the seal by the sharp inner edge of the pointed extension.

The claw has two purposes. Often, bottles are sealed with a shrink outer wrap around the cap. The edge is sometimes hard to see and to grasp with finger nails. The claw point easily gets between the outer wrap and the cap whereby the sharpened inner curve can cut it away. A second use of the claw section is to remove cotton that might be used inside a pill bottle; it is inserted to snag the cotton to pull it out.

The outer sharpened edge of the pointed extension serves well as a letter opener.

An optional sliding cover that is inexpensive to manufacture and keeps the front end away from contaminants is also described for this embodiment.

BRIEF DESCRIPTION OF THE DRAWINGS

The present invention can best be understood in connection with the accompanying drawings. It is noted that the invention is not limited to the precise embodiments shown in drawings, in which:

FIG. 1 is a bottom view of a bottle cap with a bottom slot of the first embodiment.

FIG. 2 is a side view of the cap of FIG. 1.

FIG. 3 is a side elevation illustrating the use of bottle cap of FIGS. 1 and 2 in cutting through a seal.

FIG. 4 is a perspective view of a bottle cap with a side slot of the second embodiment.

FIG. 5 is a crossectional side view of the bottle cap of FIG. 4

DETAILED DESCRIPTION OF THE INVENTION

Figure 8:
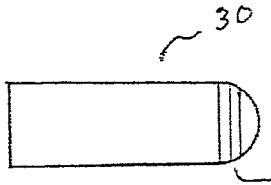
FIG. 8 is a bottom view of a rigid tab of the fifth embodiment of this invention.

FIGS. 1-3 show the bottle cap 1 of the first embodiment. Notch 2 separates the bottom edge of cap 1 into the main cap and a short segment 3 (which may be pointed as shown). By placing notch 2 over the edge of the opening of bottle 8 (as shown in FIG. 3) seal 7 can be penetrated and then removed by twisting bottle 8.

As illustrated in FIGS. 1-3, cap 10 has a top wall 10*a* and a descending annular side wall 10*b* with bottom edge 10*c*. There are two spaced notched slits 2 with a portion 10*d* of said bottom edge 10*c* between the spaced notched slits 2 and having a cutting edge.

FIGS. 4 and 5 show bottle cap 10 of the second embodiment with curved side slot 11. This cap is used in the vertical position fitting slot 11 over the edge of a sealed bottle and pushing segment 12 through the seal (segment 12 can be pointed to aid in this action). Note that the circular contour 13 of segment 12 which forms one side of slot 11 matches the inside diameter of the bottle opening for easier guidance around during cutting of the seal.

Figure 6:
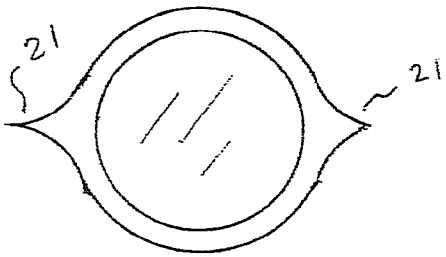
FIG. 6 is a bottom view of a bottle cap of the third embodiment with points molded into its periphery.

FIG. 6 shows the molded points 21 around the periphery of cap 20 of the third embodiment. Either of the points 21 can be used to penetrate the seal. Note how easily it can be grasped using the contour for increased leverage.

Figure 7:
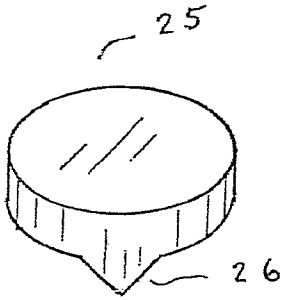
FIG. 7 is a perspective view of a bottle cap of the fourth embodiment with a downward facing point on the side.

FIG. 7 shows point 26 molded onto the bottom edge of cap 25 comprising the fourth embodiment. Point 26 is used to penetrate the seal.

Figure 9:
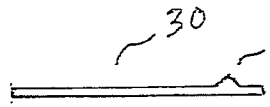
FIG. 9 is a side elevation of the tab of FIG. 8.
Figure 10:
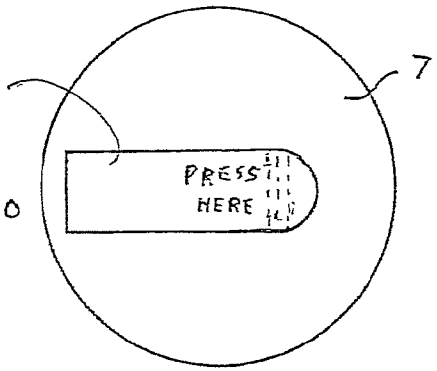
FIG. 10 is a top view of the tab of FIGS. 8 and 9 attached to the top of a seal.

FIGS. 8-10 illustrate the use of rigid tab 30 to remove seal 7 as per embodiment number 5. The bottom surface of tab 30 has a pointed region, such as line 31, protruding from the bottom surface. The pointed region can also be a pointed projection extending down from said tab. Tab 30 is bonded to the top surface of seal 7. When pressed in the vicinity of line 31 or other region, tab 30 will penetrate seal 7 and it can then be removed by grasping the torn edges.

Figure 11:
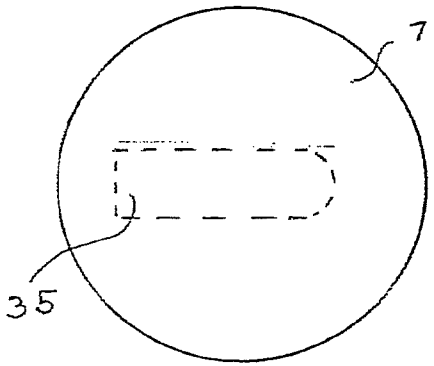
FIG. 11 is a top view of the sixth embodiment illustrating a rigid tab laminated inside a seal.

FIG. 11 shows a sixth embodiment of a laminated rigid tab 35 with sharp edges. Pressure on this tab will cause it to penetrate and tear seal 7.

Figure 12:
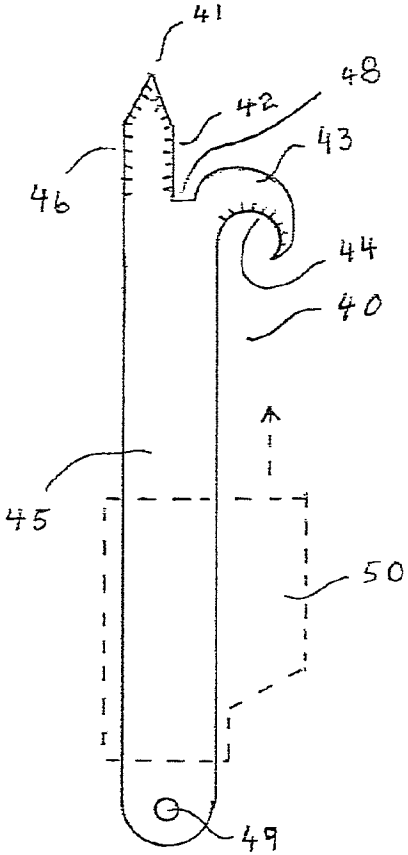
FIG. 12 is a top view of the multi-purpose tool of the seventh embodiment of this invention.

FIG. 12 shows multi-purpose tool 40 which is the seventh embodiment of this invention. This is a flat rigid plastic (or metal) tool with handle 45, pointed extension 46 with point 41, slot 48, and claw 43. Edges that are knife edges (or somewhat sharp) are illustrated by the array of short lines along the edge. Hole 49 permits attachment of chain, key ring, or lanyard. To remove a seal, the seal is pierced by point 41 near an edge with slot 48 riding the edge of the bottle. By twisting tool 40 with edge 42 in the desired direction and following the bottle edge around, cutting edge 42 will quickly remove the seal.

Claw 43 is used to get underneath an over-cap shrink wrap and then cut through with edge 44 to remove it. Claw 43 can also be used to remove cotton wadding from a pill bottle by pushing it inside and snagging the cotton to pull it out.

Figure 13:
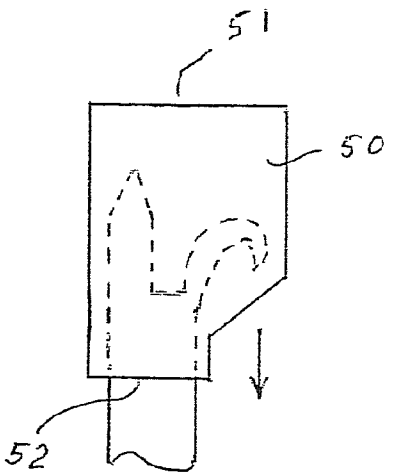
FIG. 13 is a top view of the optional cover for the tool of FIG. 12.

Point 41 and outside extension side 46 serve as an excellent letter opener. An optional cover 50 shown in FIG. 13 can be used to keep the front end of tool 40 away from contaminants which may be picked up on a counter-top, a drawer, or a purse for example. This simple cover is preferably dip molded of plastisol. It is designed to stay on handle 45 during use and to be slid over the front end when tool 40 is not in use. A tight fit slot at edge 52 permits it to slide along handle 45, while a self-closing slit at edge 51 closes over the working parts and opens easily when required. It can be removed completely if not desired.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A container seal breaker for a container having a cap over a seal extending over a top opening in the container, said seal breaker comprising:

a container cap;

said container cap having at least one notch slit wide enough to engage over the edge of the container, said container having a rigid section adjacent to said notch slit, said rigid section adjacent said notch slit capable of exerting force against the seal of the container with sufficient force to rupture the seal;

said at least one slot of said container cap is a curved side slot, wherein a circular contour of a segment of said container cap forms one side of said curved side slot matching an inside diameter of the top opening during cutting of the seal.

2. A container seal breaker for a container having a cap over a seal extending over a top opening in the container, said seal breaker comprising:

a container cap;

said container cap having at least one molded point extending outwardly from said cap at a selected location on a peripheral edge of said cap.

3. The container seal breaker as in claim 2 wherein said at least one point extends from a peripheral side edge of said container cap.

4. The container seal breaker as in claim 2 wherein said at least one point extends from the bottom peripheral edge of said container cap.

5. A container seal breaker for a container having a cap over a seal extending over a top opening in the container, said seal breaker comprising a rigid tab bonded to the top surface of a seal sealing a top of a medicine or other commodity container, a bottom surface of said bonded tab having a pointed region protruding from said bottom surface of said bonded tab;

wherein, when pressed in the vicinity of said bonded region, said bonded tab and said pointed region will penetrate the seal, wherein said seal can then be removed by grasping torn edges of the seal after said seal is punctured by said pointed region of said bonded tab.

6. The container seal breaker as in claim 5 wherein said pointed region is a line extending across said bonded tab.

7. The container seal breaker as in claim 5 wherein said pointed region is a pointed projection on said bonded tab.

8. The container seal breaker as in claim 5 wherein said pointed region is an edge of said bonded tab.

* * * * *